US007730729B2

(12) United States Patent
Yakumaru et al.

(10) Patent No.: US 7,730,729 B2
(45) Date of Patent: Jun. 8, 2010

(54) REFRIGERATING MACHINE

(75) Inventors: Yuuichi Yakumaru, Osaka (JP); Tetsuya Saito, Yamaguchi (JP); Tomoichiro Tamura, Kyoto (JP); Masaya Honma, Osaka (JP)

(73) Assignee: Panasonic Corporation, Osaka (JP)

( * ) Notice: Subject to any disclaimer, the term of this patent is extended or adjusted under 35 U.S.C. 154(b) by 389 days.

(21) Appl. No.: 11/884,048

(22) PCT Filed: Feb. 8, 2006

(86) PCT No.: PCT/JP2006/302176

§ 371 (c)(1),
(2), (4) Date: Aug. 9, 2007

(87) PCT Pub. No.: WO2006/085557

PCT Pub. Date: Aug. 17, 2006

(65) Prior Publication Data

US 2008/0168781 A1 Jul. 17, 2008

(30) Foreign Application Priority Data

Feb. 10, 2005 (JP) ..... 2005-035225

(51) Int. Cl.
*F21D 21/06* (2006.01)

(52) U.S. Cl. ..... 62/155; 62/86; 62/234

(58) Field of Classification Search ..... 62/86, 62/87, 155, 140, 197, 236, 234, 402
See application file for complete search history.

(56) References Cited

U.S. PATENT DOCUMENTS 2,091,884 A * 8/1937 Rottner ..... 62/80
3,151,470 A * 10/1964 Quick ..... 62/278
4,246,760 A * 1/1981 Cann et al. ..... 62/81
4,326,868 A * 4/1982 Ozu et al. ..... 62/324.6
4,843,838 A * 7/1989 Trask ..... 62/324.6
6,851,270 B2 * 2/2005 Denvir ..... 62/234
6,966,198 B2 * 11/2005 Piccirilli et al. ..... 62/402
7,004,246 B2 * 2/2006 Gavula ..... 165/299

(Continued)

FOREIGN PATENT DOCUMENTS

JP 02-259379 10/1990

(Continued)

OTHER PUBLICATIONS

International Preliminary Examination Report issued in the International Application on Feb. 21, 2008.

(Continued)

*Primary Examiner*—George Nguyen
(74) *Attorney, Agent, or Firm*—Wenderoth, Lind & Ponack, L.L.P.

(57) ABSTRACT

A compressor, a radiator, an expander, and an evaporator are connected in series to define a refrigerating cycle. A bypass circuit that bypasses the expander, an on-off valve disposed in the bypass circuit, and a controller C1 for controlling an opening of the on-off valve are provided in the refrigerating cycle. During defrosting, the controller C1 controls the on-off valve so that a refrigerant may flow through the bypass circuit, thereby avoiding reduction in the amount of flow of the refrigerant during defrosting and preventing the defrosting operation from being prolonged.

9 Claims, 7 Drawing Sheets

U.S. PATENT DOCUMENTS

| | | | | |
|---|---|---|---|---|
| 7,434,414 | B2 * | 10/2008 | Sakitani et al. | 62/172 |
| 2006/0059929 | A1 * | 3/2006 | Sakitani et al. | 62/228.1 |
| 2006/0107671 | A1 * | 5/2006 | Yoshida et al. | 62/151 |
| 2006/0254276 | A1 * | 11/2006 | Sato et al. | 60/645 |
| 2008/0098758 | A1 * | 5/2008 | Moriwaki et al. | 62/222 |

FOREIGN PATENT DOCUMENTS

| | | |
|---|---|---|
| JP | 2000-234814 | 8/2000 |
| JP | 2000-329416 | 11/2000 |
| JP | 2001-116371 | 4/2001 |
| JP | 2007-17014 | 1/2007 |

OTHER PUBLICATIONS

Closed Refrigerating Machine by Mutsuyoshi Kawahira, 1981, ISBN4-88967-034-3 (pp. 278-280).

"Leading Study and Development of Basic Technology for Effective Utilization of Energy, Development of Two-Phase Flow Expander/Compressor for CO2 Air Conditioner" a 2002 Report by New Energy and Industrial Technology Development Organization.

* cited by examiner

REFRIGERATING MACHINE

TECHNICAL FIELD

The present invention relates to a refrigerating machine for effectively recovering energy that is generated with expansion of a fluid.

BACKGROUND ART

In a conventional refrigerating machine having an expansion valve, a plurality of systems including a hot gas bypass system have been proposed to defrost an evaporator. Such systems are widely used in refrigerating machines or air conditioners for home use or official use (see, for example, non-patent document 1).

FIG. 12 is a block diagram of a refrigerating machine of the conventional hot gas bypass system as disclosed in the non-patent document 1.

In this refrigerating machine, a compressor 1, a radiator 2, a throttling device 14, and an evaporator 4 are connected in the form of a loop, and a bypass circuit 6 having an on-off valve 7 is interposed between an outlet of the compressor 1 and an inlet of the evaporator 4. During normal operation, a refrigerant is sucked into and compressed by the compressor 1, and the refrigerant discharged from the compressor 1 is cooled by the radiator 2 and discharged therefrom. The refrigerant is then reduced in pressure by the throttling device 14 and expands consequently. Upon evaporation in the evaporator 4, the refrigerant is again sucked into the compressor 1. During defrosting operation, when the on-off valve 7 is opened, the refrigerant discharged from the compressor 1 is led into the evaporator 4 through the bypass circuit 6 that bypasses the radiator 2 and the throttling device 14. Accordingly, the high-temperature refrigerant flows thorough the evaporator 4 and, hence, increases the temperature of the evaporator 4, making it possible to defrost the evaporator 4.

In recent years, however, a power recovery cycle has been proposed having an expander in place of the expansion valve in order to further enhance the efficiency of the refrigerating cycle. In this power recovery cycle, the expander acts to recover, when the refrigerant expands, pressure energy in the form of electric power or mechanical power, thereby reducing the input of the compressor by the amount of being recovered (see, for example, patent document 1).

FIG. 13 is a block diagram of the conventional refrigerating machine as disclosed in the patent document 1.

In the refrigerating machine as shown in FIG. 13, a compressor 1 is driven by a drive means (not shown) such as, for example, an automobile engine to suck and compress a refrigerant. The refrigerant discharged from the compressor 1 is cooled by a radiator 2, which in turn discharges the refrigerant towards an expander 3. The expander 3 then converts expansion energy of the refrigerant into mechanical energy (rotational energy) so that the mechanical energy (rotational energy) recovered may be supplied to a generator 5 for generation of electric power. The refrigerant that has been reduced in pressure and has expanded in the expander 3 evaporates in an evaporator 4 before it is again sucked into the compressor 1.

FIG. 14 is a Mollier diagram of the refrigerating machine of FIG. 13.

In the refrigerating machine, because the expander 3 reduces the pressure of the refrigerant while converting expansion energy into mechanical energy, the refrigerant discharged from the radiator 2 reduces enthalpy while undergoing a phase change along an isentropic curve (c→d), as shown in FIG. 14. Accordingly, as compared with a case wherein during pressure reduction the refrigerant merely undergoes adiabatic expansion without doing expansion work (an isenthalpic change), the phase change along the isentropic curve can increase enthalpy at the evaporator 4 by an amount corresponding to expansion work Δiexp, making it possible to increase the refrigerating capacity. Also, because mechanical energy (rotational energy) can be supplied to the generator 5 by the expansion work Δiexp, the generator 5 can generate electric power corresponding to Δiexp, which is in turn supplied to the compressor 1. As such, electric power required for driving the compressor 1 can be reduced and, hence, the coefficient of performance (COP) of the refrigerating cycle can be enhanced.

Further, in the power recovery refrigerating machine referred to above, a proposal has been made wherein a bypass expansion valve is provided in a circuit employing an expander and a generator separated therefrom (see, for example, non-patent document 2).

Another refrigerating cycle has been proposed wherein an expander and a compressor are connected to each other via a shaft so that energy recovered by the expander may be utilized to drive the compressor. In this refrigerating cycle, in order to avoid a limitation of the constant density ratio, a bypass circuit for bypassing the expander and a control valve for controlling the flow passage area of the bypass circuit are provided wherein the control valve for the bypass circuit is fully opened at the start of the cycle (see, for example, patent document 2).

Non-patent document 1: Closed Refrigerating Machine, 1981, ISBN4-88967-034-3 (pages 278-280)

Non-patent document 2: "Leading Study and Development of Basic Technology for Effective Utilization of Energy, Development of Two-Phase Flow Expander/Compressor for CO2 Air Conditioner" a 2002 Report by New Energy and Industrial Technology Development Organization Patent document 1: Japanese Patent Publication No. 2000-329416

Patent document 2: Japanese Patent Publication No. 2001-116371

DISCLOSURE OF THE INVENTION

Problems to be Solved by the Invention

However, because the expander 3 is driven by the utilization of a difference between high and low pressures in the refrigerating cycle, the above-described conventional construction lacks torque required to drive the expander 3 under the condition in which the refrigerating cycle is unstable, for example, at the start of the defrosting operation or when the refrigerating cycle has returned to the normal operation after the defrosting operation, and a sufficient difference between the high and low pressures is not established. As a result, the compressor 1 continues to operate while the expander 3 is not driven. At this time, the refrigerating cycle is under the condition in which there is little refrigerant flow in the expander 3, and the refrigerant flow in the whole refrigerating cycle reduces, followed by a reduction in the quantity of heat to be given to the evaporator 4. Accordingly, the defrosting operation is prolonged, thus lowering amenity and the efficiency. This tendency is particularly conspicuous not with the hot gas bypass system but with a construction having no bypass circuit in which the defrosting operation is conducted by switching the high pressure side to the low pressure side and vice versa.

Patent document 2 discloses that a bypass control valve is fully opened at the start of a system to avoid a mechanical loss in the system and does not disclose any control during the defrosting operation.

The present invention has been developed to overcome the above-described disadvantages. It is accordingly an objective of the present invention to provide a reliable refrigerating machine capable of enhancing amenity and efficiency by shortening the defrosting operation.

Means to Solve the Problems

In accomplishing the above objective, the present invention is intended to provide a refrigerating machine that includes a compressor, a first heat-exchanger, an expander, and a second heat-exchanger, all connected in series to define a refrigerating cycle and is characterized by a generator connected to the expander, a bypass circuit that bypasses the expander, a refrigerant regulator disposed in the bypass circuit, and a controller operable to control an opening of the refrigerant regulator, wherein during defrosting, the controller controls the refrigerant regulator to open it to thereby flow a refrigerant through the bypass circuit, and also controls a speed of the expander to a predetermined value with the generator used as a motor to thereby increase an amount of refrigerant in the refrigerating cycle.

In this case, it is possible for the controller not to control the speed of the expander.

The controller may include a timer that counts a time period from start of the compressor, and after a lapse of a predetermined time period from the start of the compressor, the controller can control the refrigerant regulator to close it to thereby block the refrigerant flowing through the bypass circuit.

Alternatively, the refrigerating machine includes a first pressure sensor operable to detect a pressure of the refrigerating cycle from a discharge side of the compressor to the expander, wherein when the first pressure sensor detects a pressure greater than a predetermined value, the controller controls the refrigerant regulator to close it to thereby block the refrigerant flowing through the bypass circuit.

Preferably, the refrigerating machine includes a first pressure sensor operable to detect a pressure of the refrigerating cycle from a discharge side of the compressor to the expander and a second pressure sensor operable to detect a pressure of the refrigerating cycle from an outlet of the expander to a suction side of the compressor, wherein when a pressure difference between the pressure detected by the first pressure sensor and the pressure detected by the second pressure sensor becomes greater than a predetermined value, the controller controls the refrigerant regulator to close it to thereby block the refrigerant flowing through the bypass circuit.

Alternatively, the refrigerating machine includes a temperature sensor operable to detect a temperature of the refrigerating cycle from a discharge side of the compressor to an inlet of the first heat-exchanger, wherein when the temperature sensor detects a temperature greater than a predetermined value, the controller controls the refrigerant regulator to close it to thereby block the refrigerant flowing through the bypass circuit.

The refrigerant regulator may be a throttling device having a varying opening. In this case, the controller controls the opening of the throttling device to reduce the amount of refrigerant flowing through the bypass circuit.

The refrigerating cycle can be constructed such that a water refrigerant heat-exchanger is employed as the first heat-exchanger while an evaporator is employed as the second heat-exchanger, or such that an indoor heat-exchanger is employed as the first heat-exchanger, while an outdoor heat-exchanger is employed as the second heat-exchanger.

The use of a refrigerant that can hold a pressure on a high-pressure side of the refrigerating cycle in a supercritical state is preferred.

EFFECTS OF THE INVENTION

According to the refrigerating machine in accordance with the present invention, because the refrigerant flow in the refrigerating cycle is increased during the defrosting operation by flowing the refrigerant through the bypass circuit and increasing the speed of the expander, the refrigerant flow in the evaporator is prevented from being reduced to thereby increase the amount of heat-exchange, making it possible to shorten the defrosting operation and enhance amenity and efficiency.

EXPLANATION OF REFERENCE NUMERALS

Figure 1:
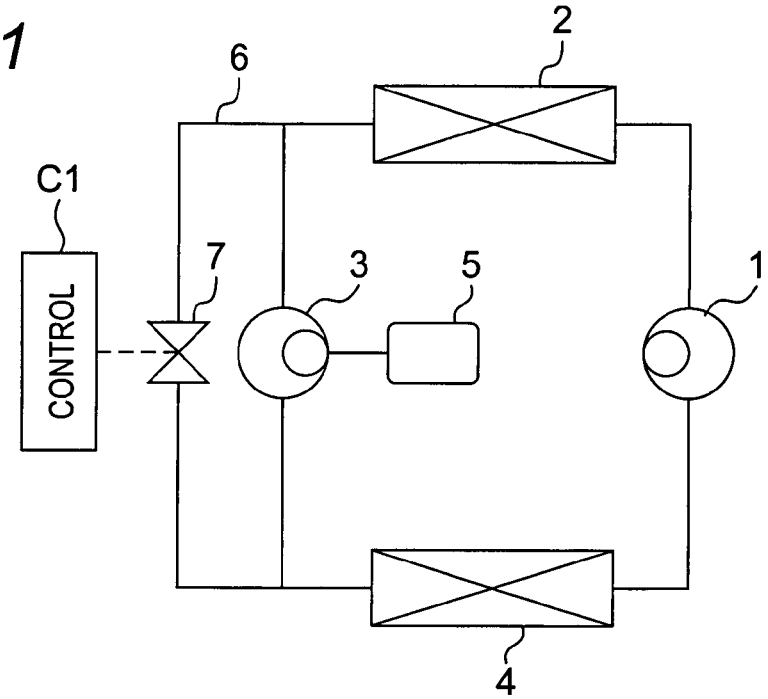
FIG. 1 is a block diagram of a refrigerating machine according to a first reference example of the present invention.

1 compressor
2 radiator
3 expander
4 evaporator
5 generator
6 bypass circuit
7 on-off valve
8 indoor heat-exchanger
9 outdoor heat-exchanger
10 four-way valve
11 first pressure sensor
12 second pressure sensor
13 temperature sensor
C1, C2 controller

BEST MODE FOR CARRYING OUT THE INVENTION

Embodiments of the present invention are explained hereinafter with reference to the drawings.

Reference Example 1

FIG. 1 is a block diagram of a refrigerating machine according to a first reference example of the present invention, wherein component parts identical with those in the prior art are designated by identical reference numerals.

As shown in FIG. 1, the refrigerating machine according to this reference example includes a compressor 1, a radiator 2 employed as a first heat-exchanger, an expander 3 for recovering power by converting expansion energy of a refrigerant into mechanical energy, and an evaporator 4 employed as a second heat-exchanger, all connected in series by piping to define a refrigerating cycle. This refrigerating machine also includes a bypass circuit 6 that bypasses the expander 3, an on-off valve 7 provided as a refrigerant flow regulator in the bypass circuit 6, and a controller C1 for controlling the opening of the on-off valve 7. The controller C1 is provided with a timer (not shown).

The expander 3 acts to convert expansion energy of the refrigerant into mechanical energy (rotational energy), and the mechanical energy (rotational energy) recovered by the expander 3 is supplied to a generator 5 for generation of electric power. The electric power so generated is utilized to drive the compressor 1, a fan for the evaporator 4, or the like.

The above-described construction in which upon receipt of the expansion energy recovered by the expander 3 the generator 5 generates electric power can recover the expansion energy without directly connecting the compressor 1 and the expander 3 via a shaft. For this reason, the compressor 1 and the expander 3 can be controlled independently.

Figure 2:
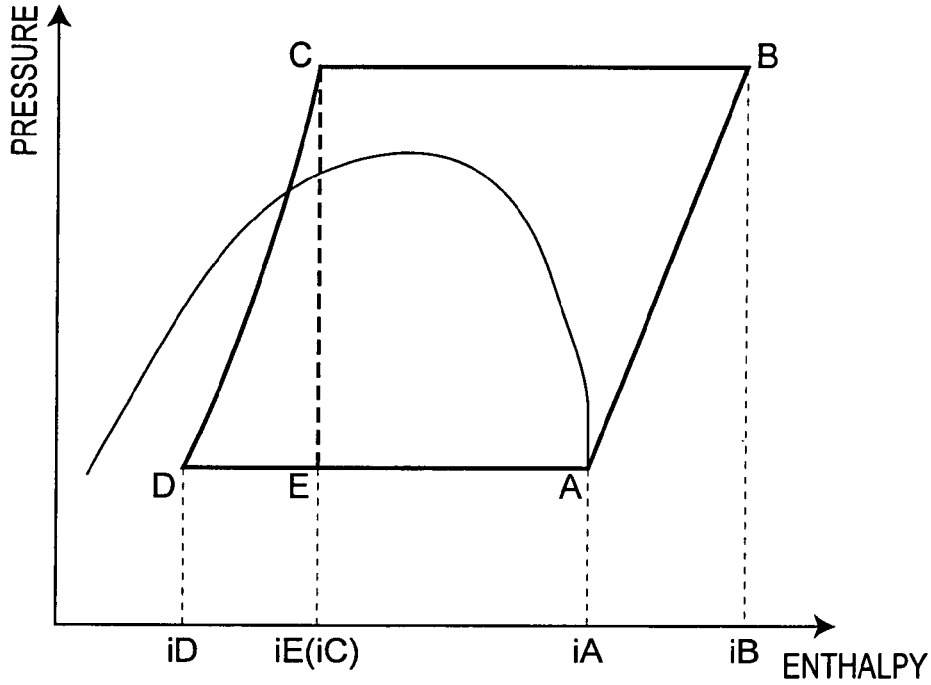
FIG. 2 is a Mollier diagram of the refrigerating machine of FIG. 1.

Taking the case of a water heater for home use, the normal operation of the refrigerating machine of the above-described construction is explained hereinafter in terms of a change in energy conditions of the refrigerant with reference to a Mollier diagram of the refrigerating machine as shown in FIG. 2.

A low-temperature and low-pressure refrigerant sucked into the compressor 1 is compressed by the compressor 1 and discharged therefrom in the form of a high-temperature and high-pressure refrigerant (A→B in the figure). The refrigerant so discharged heat-exchanges with water (not shown) in the radiator 2 and radiates heat while heating water up to a high-temperature of about 80° C. before the refrigerant is led into the expander 3 (B→C). In the expander 3, the refrigerant undergoes isentropic expansion and is reduced in pressure while generating mechanical energy before the refrigerant reaches the evaporator 4. At this moment, the on-off valve 7 is kept fully closed by the control of the controller C1 (C→D). Thereafter, the refrigerant heat-exchanges with outside air in the evaporator 4 and turns into a gaseous refrigerant, which is in turn sucked into the compressor 1 via a suction pipe (D→A).

Where the radiator 2 is used as a heating source for a water heater, a room heater, a vending machine, or the like, if electric power generated by the generator 5 is utilized to drive the compressor 1, the coefficient of performance becomes COP=(iB−iC)/((iB−iA)−(iE−iD)). Accordingly, as compared with a conventional refrigerating machine in which the refrigerant undergoes isenthalpic expansion in an expansion valve, a capillary tube or the like, not only the power for the compressor 1 reduces, but the refrigerating capacity also increases, making it possible to further enhance the efficiency.

Also, where the evaporator 4 is used as a cooling source for a refrigerator for home use, a refrigerator for official use, a cooler, an ice making machine, a vending machine, or the like, if electric power generated by the generator 5 is utilized to drive the compressor 1, the coefficient of performance becomes COP=((iA−iE)+(iE−iD))/((iB−iA)−(iE−iD)). Accordingly, as compared with the conventional refrigerating machine in which the refrigerant undergoes isenthalpic expansion in the expansion valve or the capillary tube, not only the power for the compressor 1 reduces, but the refrigerating effect also increases, making it possible to further enhance the efficiency.

A method of controlling the refrigerating machine according to this reference example at the start of the defrosting operation is explained hereinafter.

Figure 3:
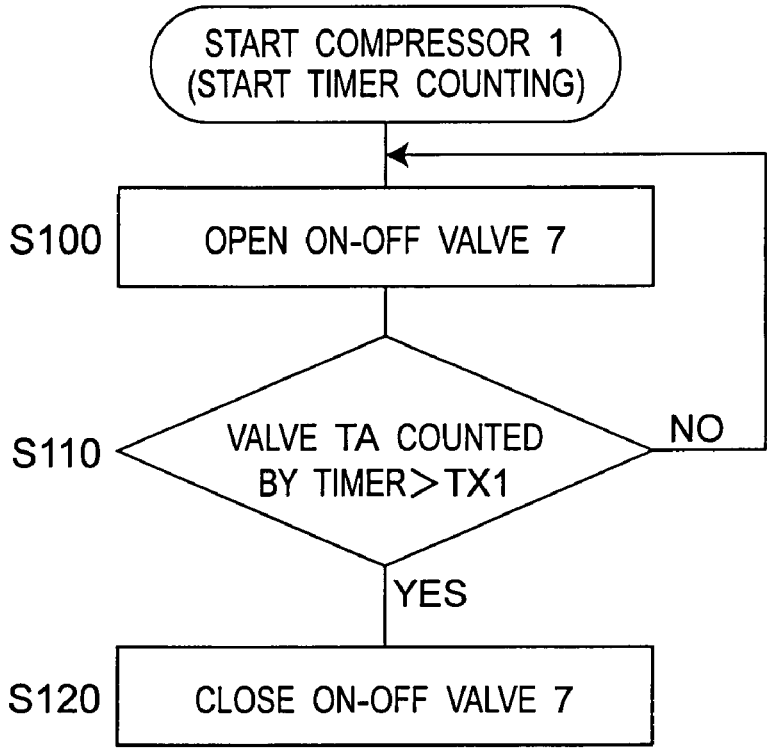
FIG. 3 is a flowchart showing a control of the refrigerating machine of FIG. 1.
Figure 4:
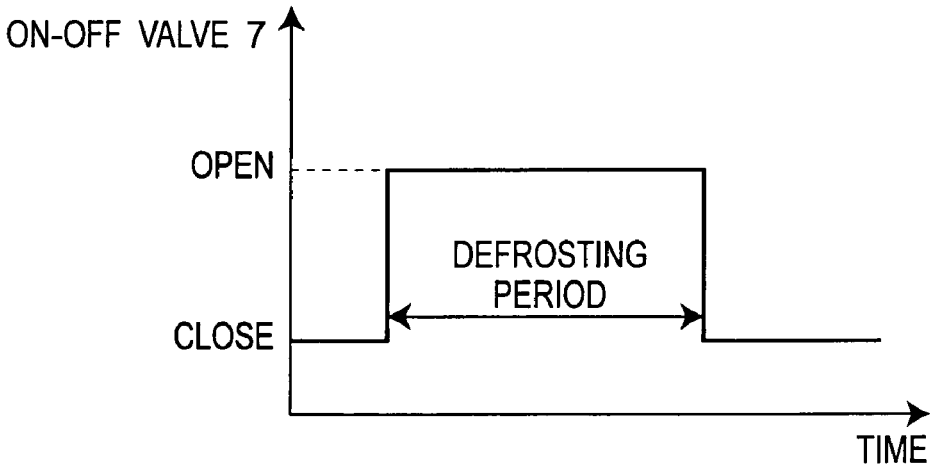
FIG. 4 is a graph showing an opening control pattern of an on-off valve provided in the refrigerating machine of FIG. 1.

FIG. 3 is a flowchart showing the control to be performed by the controller C1 according to this reference example, and FIG. 4 is a control pattern to control the opening of the on-off valve 7 according to this reference example and shows a defrosting time period from beginning to end of the defrosting operation to be performed by the on-off valve 7.

When the compressor 1 starts at the start of the defrosting operation, the timer provided in the controller C1 starts counting, followed by step 100, at which the controller C1 controls the on-off valve 7 to open the opening thereof, and the procedure advances to step 110. At this moment, the operation of the refrigerating cycle is such that the expander 3 recovers no expansion energy (the expander 3 is held at a standstill), and the refrigerant undergoes isenthalpic expansion in the on-off valve 7. Such an opening control of the on-off valve 7 by the controller C1 can avoid reduction in the amount of flow of the refrigerant during the defrosting operation, making it possible to prevent the defrosting operation from being prolonged.

At step 110, a value TA counted by the timer is compared with a predetermined set time TX1 (this set time is discussed later). If TA is greater than TX1, the procedure advances to step 120 at which the controller C1 controls the on-off valve 7 to fully close it so that the refrigerant may be supplied to only the expander 3. This operation mode is a mode in which the expansion energy is recovered to the utmost limit. In contrast, if TA is less than or equal to TX1, the procedure returns to step 100 to avoid clogging of the refrigerating cycle. The operation with the use of the bypass circuit 6 continues until the value TA counted by the timer becomes greater than TX1.

The defrosting operation can be started with the use of, for example, a temperature sensor mounted on a pipe within the evaporator 4. In this case, if the temperature sensor detects a temperature less than a predetermined one (for example, 0° C.) for a predetermined time period (for example, 40 minutes), the controller C1 determines that frost has been formed on the evaporator 4 and starts the timer.

Figure 5:
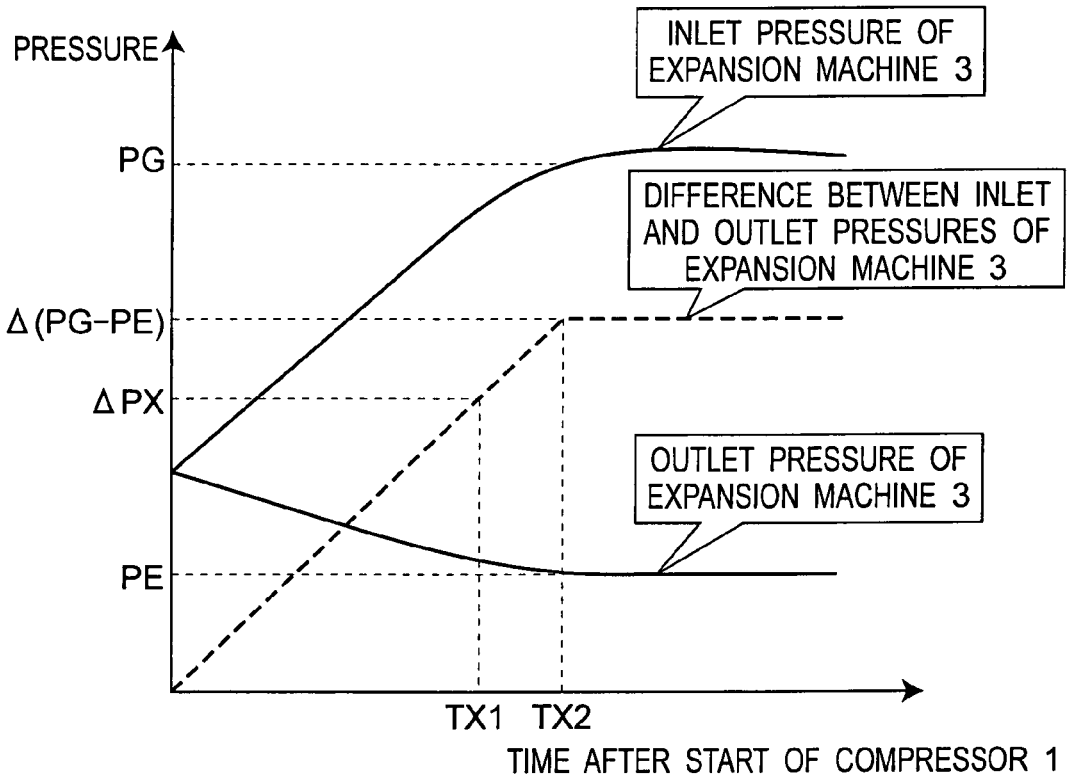
FIG. 5 is a graph showing a pressure change in the refrigerating machine of FIG. 1.

FIG. 5 is a graph showing a pressure change in the refrigerating machine according to this reference example, wherein an inlet pressure and an outlet pressure of the expander 3 after the start of the compressor 1 are indicated by respective solid lines, while a pressure difference between the inlet pressure and the outlet pressure of the expander 3 (this pressure difference is hereinafter referred to as a pressure difference between the inlet and outlet pressures) is indicated by a dotted line.

As shown in FIG. 5, the inlet pressure and the outlet pressure of the expander 3 balance with each other before the start of the compressor 1 and, hence, the pressure difference therebetween is approximately 0 (MPa). When the compressor 1 starts, the inlet pressure of the expander 3 gradually increases, while the outlet pressure of the expander 3 gradually reduces. When the pressure difference between the inlet and outlet pressures of the expander 3 reaches a fixed pressure difference ΔPX (MPa) indicating that the torque exceeds a predetermined value, a movable scroll (not shown) starts, when a scroll expander is employed as the expander 3, to rotate to thereby expand the refrigerant under a reduced pressure and recover expansion energy.

With the lapse of a certain time period, the inlet pressure and the outlet pressure of the expander 3 become respective constant pressures PG (MPa) and PE (MPa), and the refrigerating cycle stabilizes. Similarly, the pressure difference between the inlet and outlet pressures of the expander 3 gradually increases after the start of the compressor 1 and becomes a constant pressure difference Δ(PG−PE) (MPa) upon lapse of the aforementioned certain time period, resulting in stabilization of the refrigerating cycle.

For this reason, the time period from when the compressor 1 starts till when the pressure difference ΔPX (MPa) required to drive the expander 3 is established can be experimentally obtained and is set as the time TX1 referred to above. Accordingly, as shown in the control flowchart of FIG. 3, whether the defrosting operation should be finished or not can be determined using the set time TX1 (step 110). When the on-off valve 7 has been fully closed by the control of the controller C1 (step 120), the pressure difference (torque) enough to drive the expander 3 is established, making it possible to promptly drive the expander 3.

As described hereinabove, in the refrigerating machine according to this reference example, at the start of the defrosting operation, i.e., at the start of the compressor 1, the refrigerant is so controlled as to pass through the bypass circuit 6, and the expander 3 is not supplied with the refrigerant until a sufficient pressure difference is established. By so doing, the amount of flow of the refrigerant increases to thereby reduce the time period of the defrosting operation and, at the same time, the power recovery effect of the expander 3 can be assuredly obtained, making it possible to enhance the efficiency of the refrigerating machine.

Meanwhile, when the pressure difference between the inlet and outlet pressures of the expander 3 has come to be Δ(PG−PE) (MPa) at which the refrigerating cycle starts to stabilize, the expander 3 is in a condition in which a sufficient refrigerant and oil can be supplied thereto.

Accordingly, a time period TX2 from when the compressor 1 starts till when the refrigerating machine starts to stabilize can be used in place of the time period TX1 in the flowchart of FIG. 3 after the former has been experimentally obtained. In this case, the set time TX2 is compared with the value TA counted by the timer (step 110), and if TA is greater than TX2, the controller C1 controls the on-off valve 7 to fully close it (step 120). By so doing, the expander 3 can be driven after the cooling effect of the refrigerant and the lubricating effect of oil have been sufficiently obtained, and it is accordingly possible to prevent sliding portions of the expander 3 from being damaged.

The relationship between the pressure difference between the inlet and outlet pressures of the expander 3 before the refrigerating cycle stabilizes and the time from the start of the compressor 1 is affected by the temperature of an ambient environment in which the refrigerating machine is installed. Accordingly, the control as shown in the control flowchart of FIG. 3 can be conducted by obtaining TX1 and TX2 in advance with respect to each ambient temperature and appropriately selecting any one of them depending on the ambient temperature detected by an ambient temperature sensor (not shown) at the start of the compressor 1, making it possible to positively enhance the reliability of the compressor 1 and that of the expander 3.

The use of a water refrigerant heat-exchanger as the radiator 2 corresponding to the first heat-exchanger according to this reference example results in a water heater (not shown) in which heat radiation from the refrigerant is utilized to heat water. As is the case with this reference example, such a water heater can shorten the defrosting operation and enhance amenity and the efficiency.

Figure 6:
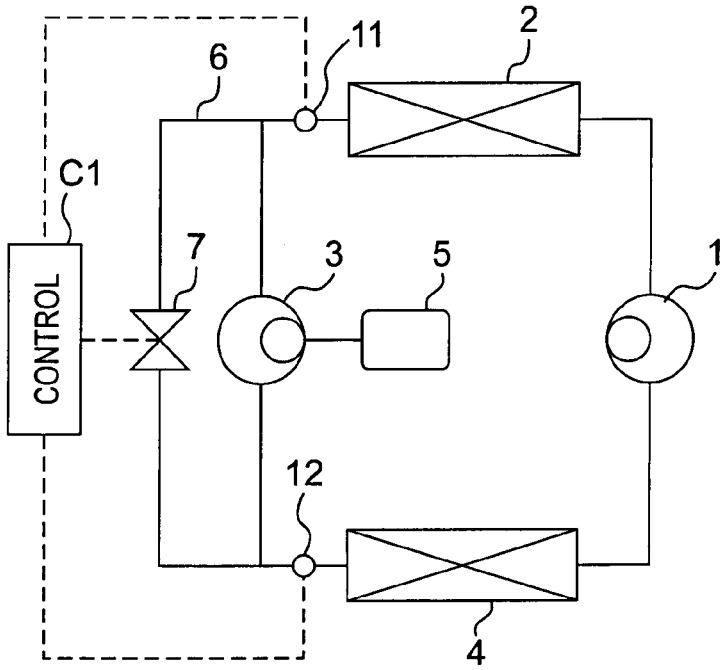
FIG. 6 is a block diagram of a modification of the refrigerating machine of FIG. 1.

As shown in FIG. 6, a first pressure sensor 11 and a second pressure sensor 12 may be additionally provided. In this case, the opening of the on-off valve 7 is controlled by a signal from the first pressure sensor 11 and that from the second pressure sensor 12, making it possible to further enhance the reliability of the compressor 1.

More specifically, the first pressure sensor 11 is mounted on a pipe extending from the discharge side of the compressor 1 to the expander 3 to detect the pressure of the refrigerating cycle (i.e., the high inlet pressure of the expander 3), while the second pressure sensor 12 is mounted on a pipe extending from the outlet of the expander 3 to the suction side of the compressor 1 to detect the pressure of the refrigerating cycle (i.e., the low outlet pressure of the expander 3).

As described hereinabove, when the pressure difference between the inlet and outlet pressures of the expander 3 reaches a fixed pressure difference ΔPX (MPa) indicating that the torque exceeds a predetermined value, a movable scroll starts, when a scroll expander is employed, to rotate to thereby expand the refrigerant under a reduced pressure and recover expansion energy.

Accordingly, if the pressure difference between the pressure detected by the first pressure sensor 11 and that detected by the second pressure sensor 12, i.e., the pressure difference between the inlet and outlet pressures of the expander 3 is less than the set value ΔPX (MPa), the controller C1 appropriately controls the opening of the on-off valve 7 to flow the refrigerant through the bypass circuit 6.

On the other hand, if the pressure difference between the pressure detected by the first pressure sensor 11 and that detected by the second pressure sensor 12 is greater than or equal to the set value ΔPX (MPa), the controller C1 controls the on-off valve 7 to fully close it to thereby supply the refrigerant to only the expander 3, resulting in an operation mode in which expansion energy of the refrigerant is recovered to the utmost limit.

In the refrigerating machine of the above-described construction, the condition of the refrigerating cycle can be grasped more accurately by detecting the pressures of the refrigerating cycle, and the operation mode is not switched to an operation in which expansion energy is recovered by the expander 3 until a high pressure suitable to drive the expander 3 is established. By so doing, clogging of the refrigerating cycle that may be caused by a shortage of torque for driving the expander 3 can be positively avoided, making it possible to further enhance the reliability of the compressor 1.

Also, the time period of the operation in which the refrigerant bypasses the expander 3 at the start of the compressor 1 can be minimized by accurately grasping the condition of the refrigerating cycle, making it possible to restrain a power loss at the start of the compressor 1 to a minimum.

As described previously, when the pressure difference between the inlet and outlet pressures of the expander 3 has come to be Δ(PG−PE) (MPa) at which the refrigerating cycle starts to stabilize, the expander 3 is in a condition in which a sufficient refrigerant and oil can be supplied thereto. Accordingly, upon experimental finding of Δ(PG−PE) (MPa), when the difference between the pressure detected by the first pressure sensor 11 and that detected by the second pressure sensor 12 exceeds the set value Δ(PG−PE) (MPa), the controller C1 controls the on-off valve 7 to close it to thereby block the refrigerant flowing through the bypass circuit 6 and start supplying the refrigerant to the expander 3. As such, the expander 3 is not driven until the cooling effect of the refrigerant and the lubricating effect of oil are sufficiently obtained, making it possible to prevent sliding portions of the expander 3 from being damaged.

Because the pressure difference between the inlet and outlet pressures of the expander 3 greatly depends on the inlet pressure of the expander 3, the operation mode with the use of the expander 3 and the operation mode with the use of the bypass circuit 6 can be switched over depending on only the pressure detected by the first pressure sensor 11 (i.e., the inlet pressure of the expander 3). In this case, the second pressure sensor 12 is not required, resulting in an inexpensive refrigerating machine.

Figure 7:
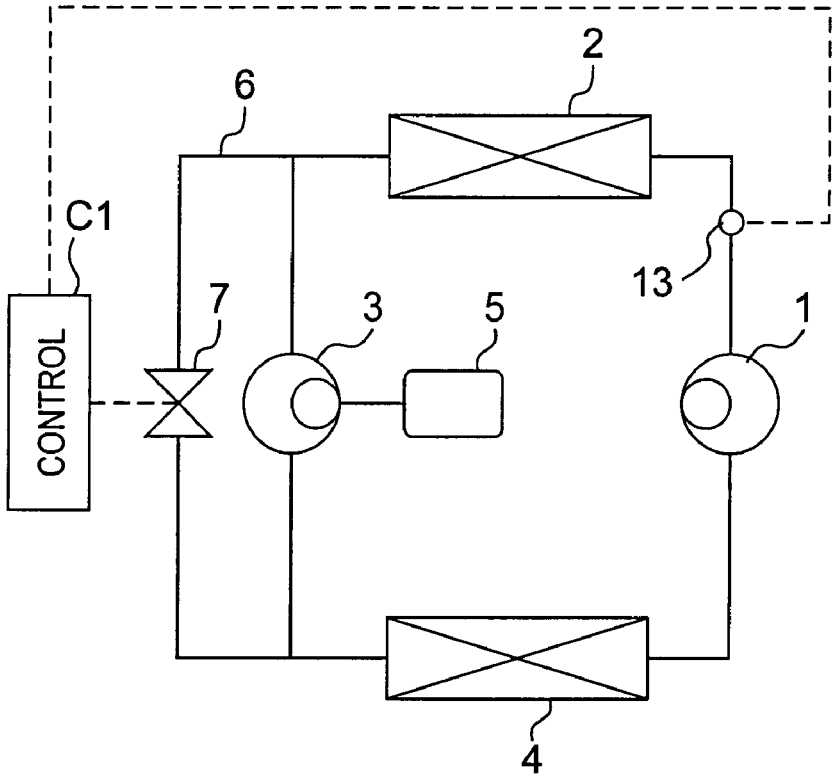
FIG. 7 is a block diagram of another modification of the refrigerating machine of FIG. 1.

Further, as shown in FIG. 7, a temperature sensor 13 for detecting the temperature of the refrigerating cycle may be additionally provided, in place of the first and second pressure sensors 11 and 12 as shown in FIG. 6, on a pipe extending from the discharge side of the compressor 1 to the inlet of the radiator 2. In this case, the opening of the on-off valve 7 is controlled by a signal from the temperature sensor 13, making it possible to further enhance the reliability of the compressor 1.

That is, the pressure of the refrigerating cycle from the discharge side of the compressor 1 to the expander 3 has an interrelation with the temperature of the refrigerating cycle from the discharge side of the compressor 1 to the inlet of the radiator 2. Accordingly, when the temperature sensor 13 detects a temperature of the refrigerating cycle over a set temperature, the controller C1 controls the on-off valve 7 to close it to thereby block the refrigerant passing through the bypass circuit 6 and start supplying the refrigerant to the expander 3. As such, the expander 3 is not driven until the cooling effect of the refrigerant and the lubricating effect of oil are sufficiently obtained, thus avoiding damage of sliding portions of the expander 3.

In this case, the operation mode with the use of the expander 3 and the operation mode with the use of the bypass circuit 6 can be switched over using a temperature sensor of a construction simpler than that of a pressure sensor, resulting in a more inexpensive refrigerating machine capable of enhancing the reliability of the compressor 1 and that of the expander 3.

Reference Example 2

Figure 8:
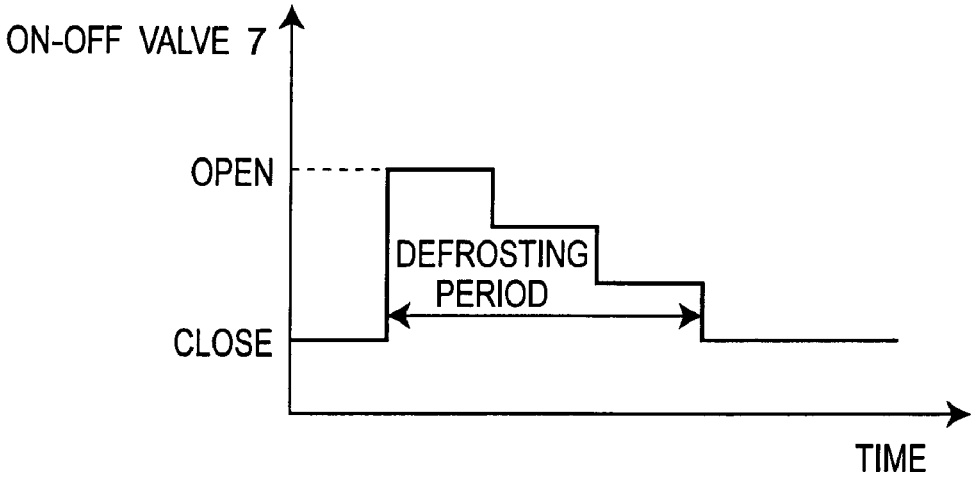
FIG. 8 is a graph showing an opening control pattern of a throttling device provided in a refrigerating machine according to a second reference example of the present invention.

FIG. 8 is a graph showing an opening control pattern of a refrigerant regulator provided in a refrigerating machine according to a second reference example of the present invention.

The refrigerating machine according to this reference example includes a refrigerant regulator in the form of a throttling device having a varying opening, which is used in place of the on-off valve 7 used in the first reference example. Because the other construction of the second reference example is the same as that of the first reference example, explanation thereof is omitted.

In this reference example, the throttling device having a varying opening is used as the refrigerant regulator and, as shown in FIG. 8, the opening of the throttling device is so controlled as to reduce step by step from beginning to end of the defrosting operation. This control can reduce the amount of refrigerant flowing through the bypass circuit 6 and, hence, it does not occur that the refrigerant would be rapidly supplied to the expander 3 when the defrosting operation has been completed.

In this way, the refrigerating machine according to this reference example can conduct a fine refrigerant control from beginning to end of the defrosting operation and also avoid a rapid change in refrigerant flow after completion of the defrosting operation. Accordingly, the start of the compressor 1 can be quickly conducted without loosing the reliability thereof, and not only can the defrosting operation be shortened, but amenity and the efficiency can be also enhanced.

It is to be noted that although in this reference example the throttling device is so controlled as to reduce the opening thereof step by step, the same effects can be obtained by controlling the throttling device to gradually reduce the opening thereof linearly or along a curved line.

Reference Example 3

Figure 9:
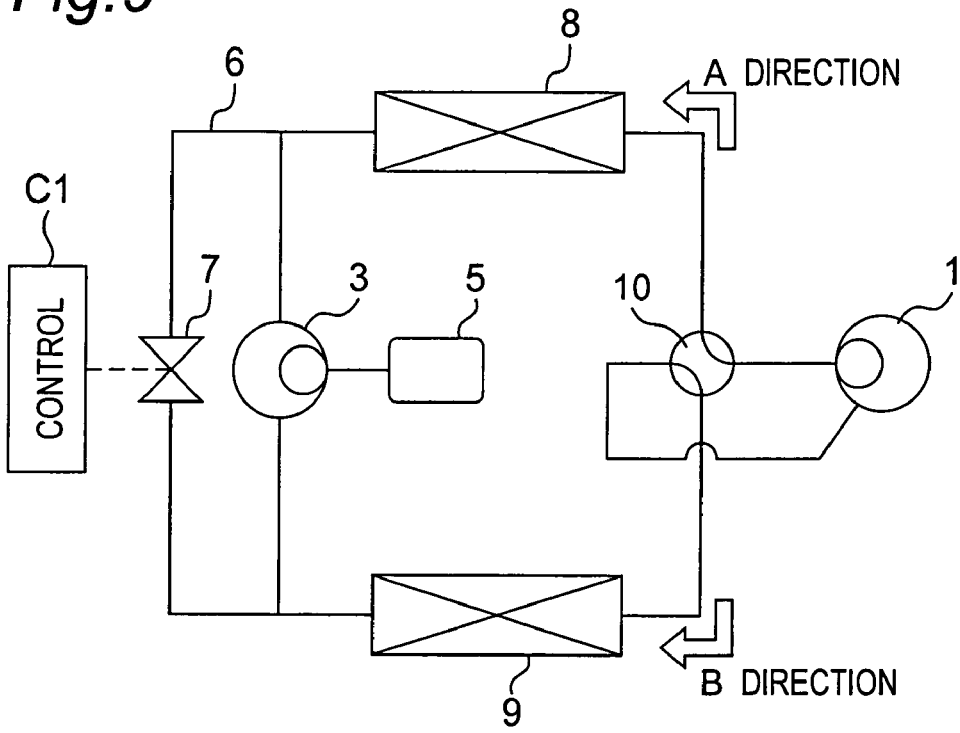
FIG. 9 is a block diagram of a refrigerating machine according to a third reference example of the present invention.

FIG. 9 is a block diagram of a refrigerating machine according to a third reference example of the present invention and depicts a modification of the first reference example referred to above.

As shown in FIG. 9, the refrigerating machine according to this reference example includes a compressor 1, a four-way valve 10, an indoor heat-exchanger 8 employed as a first heat-exchanger, an expander 3, and an outdoor heat-exchanger 9 employed as a second heat-exchanger, all of which are connected to define a refrigerating cycle. This refrigerating machine also includes a bypass circuit 6 used to bypass the expander 3, an on-off valve 7 provided in the bypass circuit 6, and a controller C1 for controlling the opening of the on-off valve 7. A generator 5 is provided to recover expansion energy of a refrigerant, which would be generated in the expander 3, in the form of electric energy.

In this refrigerating machine, the four-way valve 10 is switched over so that the refrigerant may flow in a direction of an arrow A during heating or in a direction of an arrow B during cooling.

In the refrigerating machine of the construction in which the refrigerant flow is switched between the heating and cooling operations, the defrosting operation (the defrosting of the outdoor heat-exchanger 9 during heating) is often conducted by switching the four-way valve 10. During the defrosting operation, damage of the sliding portions due to the pressure applied to the outlet of the expander 3 can be avoided by controlling the opening of the on-off valve 7 in the bypass circuit 6. Accordingly, even the refrigerating machine for both cooling and heating can shorten the defrosting operation, thereby enhancing amenity and the efficiency.

Embodiment 1

Figure 10:
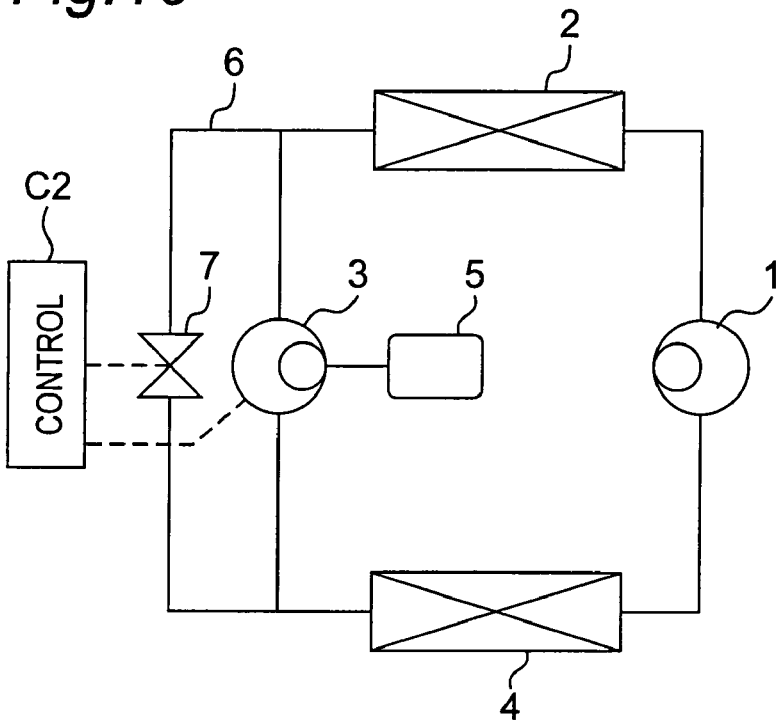
FIG. 10 is a block diagram of a refrigerating machine according to a first embodiment of the present invention.
Figure 11:
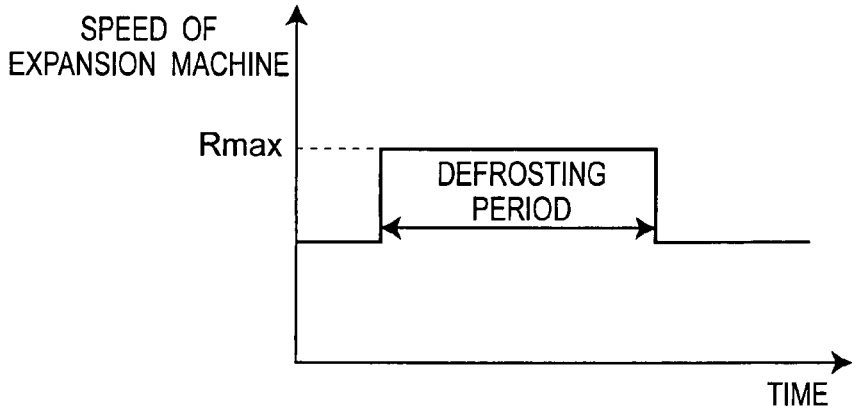
FIG. 11 is a graph showing a speed control pattern of an expander provided in the refrigerating machine of FIG. 10.
Figure 12:
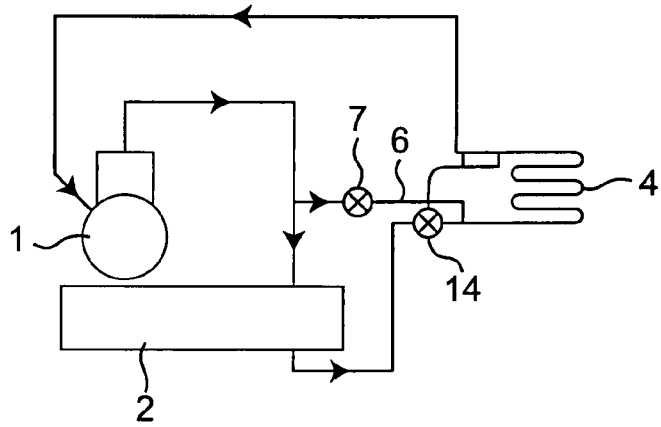
FIG. 12 is a block diagram of a refrigerating machine having a conventional hot gas bypass system.
Figure 13:
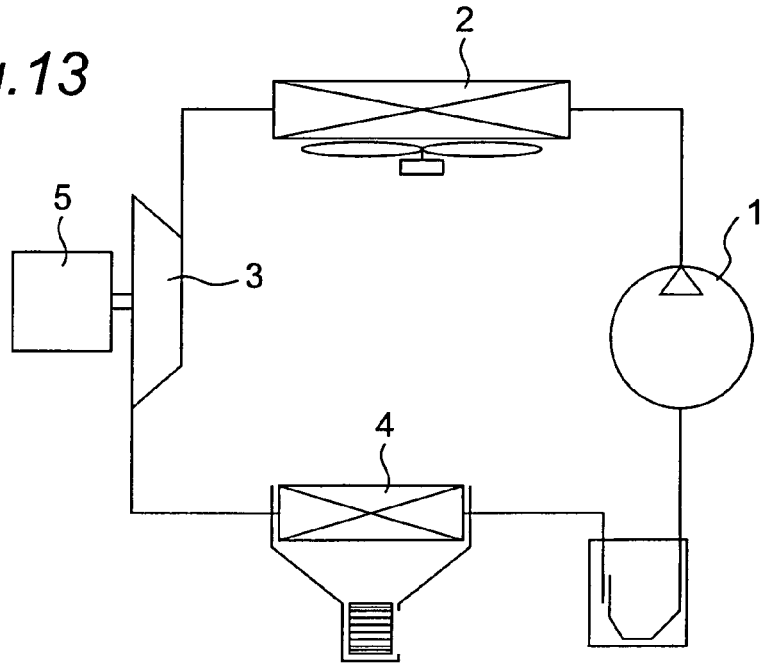
FIG. 13 is a block diagram of a conventional refrigerating machine.
Figure 14:
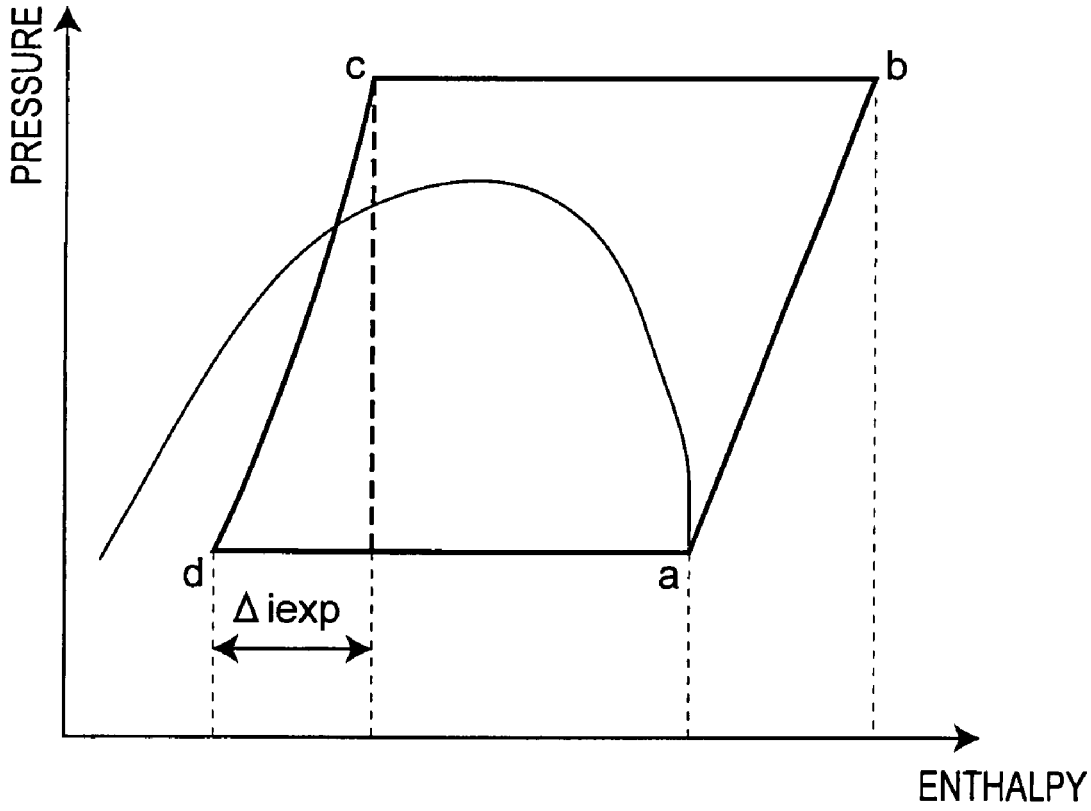
FIG. 14 is a Mollier diagram of the conventional refrigerating machine.

FIG. 10 is a block diagram of a refrigerating machine according to a first embodiment of the present invention and depicts another modification of the first reference example referred to above. FIG. 11 is a control pattern to be conducted by the controller to control the speed of the expander in this embodiment.

The refrigerating machine as shown in FIG. 10 includes a controller C2, in place of the controller C1 shown in FIG. 1, to control the opening of the on-off valve 7 and also control the speed of the expander 3.

In this embodiment, the generator 5 connected to the expander 3 is used as a motor during the defrosting operation.

That is, during the defrosting operation, the controller C2 controls the on-off valve 7 to open it to thereby flow the refrigerant through the bypass circuit 6. At the same time, as shown in FIG. 11, the motor 5 is supplied with electricity to drive the expander 3 with the speed thereof controlled to a predetermined value, thereby increasing the amount of flow of the refrigerant in the refrigerating machine to shorten the defrosting operation.

The maximum speed Rmax of the expander 3 (100 Hz when the suction capacity of the expander is 1 cc) or a speed close thereto can be selected as the predetermined value.

Upon completion of the defrosting operation, the controller C2 controls the on-off valve 7 to close it to thereby block the refrigerant flowing through the bypass circuit 6. At the same time, power supply to the motor 5 is stopped, which is in turn used as the generator 5 again, resulting in the original power recovery refrigerating machine.

As described above, the refrigerating machine according to this embodiment can increase the amount of heat-exchange in the evaporator 4 during the defrosting operation by increasing the amount of flow of the refrigerant in the refrigerating cycle, making it possible to further shorten the defrosting operation and enhance amenity and the efficiency.

This embodiment can be used together with the first reference example.

That is, if the controller C2 is provided with a timer, when the compressor 1 starts at the time of defrosting operation, the timer is caused to start counting, and the on-off valve 7 may be closed when the value counted by the timer exceeds a predetermined time period.

Alternatively, any of the pressure difference between the inlet and outlet pressures of the expander 3, the inlet pressure of the expander 3, and the temperature of the refrigerating cycle may be detected. In this case, the on-off valve 7 can be closed when the detected pressure difference, the detected pressure or the detected temperature exceeds a predetermined value.

Also, this embodiment can be used together with the second reference example. If a throttling device having a varying opening is used in place of the on-off valve 7, the amount of refrigerant flowing through the bypass circuit 6 can be gradually reduced by controlling the opening of the throttling device to reduce gradually or step by step from beginning to end of the defrosting operation, making it possible to avoid rapid supply of the refrigerant to the expander 3 after completion of the defrosting operation.

Further, this embodiment can be used with the refrigerating machine according to the third reference example having a four-way valve 10.

In the refrigerating machine according to the first to third reference examples or the first embodiment carbon dioxide can be used as the refrigerant, and the refrigerating cycle is operated with the pressure on the high-pressure side held in a supercritical state. In this case, because the difference between the high pressure and low pressure in the refrigerating cycle becomes large, the pressure difference (torque) required to rotate the expander 3 can be promptly obtained and, hence, the time period during which the refrigerant bypasses the expander 3 at the start of the compressor 1 can be shortened, making it possible to minimize a power loss at the start of the compressor 1.

INDUSTRIAL APPLICABILITY

As described above, in the refrigerating machine according to the present invention, because the refrigerant is so controlled as to flow through the bypass circuit, which bypasses the expander, at the start of defrosting operation or at the start of the compressor, the reliability of the compressor and that of the expander can be enhanced. Accordingly, the refrigerating machine according to the present invention can be widely used in various appliances such as water heaters, air conditioners, vending machines, household refrigerators, refrigerators for official use, ice making machines, and the like.

The invention claimed is:

1. A refrigerating machine comprising;

a compressor, a first heat-exchanger, an expander, and a second heat-exchanger, all connected in series to define a refrigerating cycle;

a generator connected to the expander;

a bypass circuit that bypasses the expander;

a refrigerant regulator disposed in the bypass circuit; and a controller operable to control an opening of the refrigerant regulator;

wherein during defrosting, the controller controls the refrigerant regulator to open it to thereby flow a refrigerant through the bypass circuit, and also controls a speed of the expander to a predetermined value with the generator used as a motor to thereby increase an amount of refrigerant in the refrigerating cycle.

2. The refrigerating machine according to claim 1, wherein the controller comprises a timer that counts a time period from start of the compressor, and after a lapse of a predetermined time period from the start of the compressor, the controller controls the refrigerant regulator to close it to thereby block the refrigerant flowing through the bypass circuit.

3. The refrigerating machine according to claim 1, further comprising a first pressure sensor operable to detect a pressure of the refrigerating cycle from a discharge side of the compressor to the expander, wherein when the first pressure sensor detects a pressure greater than a predetermined value, the controller controls the refrigerant regulator to close it to thereby block the refrigerant flowing through the bypass circuit.

4. The refrigerating machine according to claim 1, further comprising a first pressure sensor operable to detect a pressure of the refrigerating cycle from a discharge side of the compressor to the expander and a second pressure sensor operable to detect a pressure of the refrigerating cycle from an outlet of the expander to a suction side of the compressor, wherein when a pressure difference between the pressure detected by the first pressure sensor and the pressure detected by the second pressure sensor becomes greater than a predetermined value, the controller controls the refrigerant regulator to close it to thereby block the refrigerant flowing through the bypass circuit.

5. The refrigerating machine according to claim 1, further comprising a temperature sensor operable to detect a temperature of the refrigerating cycle from a discharge side of the compressor to an inlet of the first heat-exchanger, wherein when the temperature sensor detects a temperature greater than a predetermined value, the controller controls the refrigerant regulator to close it to thereby block the refrigerant flowing through the bypass circuit.

6. The refrigerating machine according to claim 1, wherein the refrigerant regulator comprises a throttling device having a varying opening, and the controller controls the opening of the throttling device to reduce the amount of refrigerant flowing through the bypass circuit.

7. The refrigerating machine according to claim 1, wherein the first heat-exchanger comprises a water refrigerant heat-exchanger, and the second heat-exchanger comprises an evaporator.

8. The refrigerating machine according to claim 1, wherein the first heat-exchanger comprises an indoor heat-exchanger, and the second heat-exchanger comprises an outdoor heat-exchanger.

9. The refrigerating machine according to claim 1, wherein a refrigerant that can hold a pressure on a high-pressure side of the refrigerating cycle in a supercritical state is used.

* * * * *